United States Patent [19]

Cooper

[11] 4,004,188

[45] Jan. 18, 1977

[54] STARTING CIRCUIT FOR INVERTER OPERATED GASEOUS DISCHARGE LAMPS

[75] Inventor: Robert C. Cooper, Fort Wayne, Ind.

[73] Assignee: General Electric Company, Carmel, Ind.

[22] Filed: Sept. 26, 1975

[21] Appl. No.: 617,014

[52] U.S. Cl. ..... 315/261; 315/151; 315/158; 315/224; 315/263; 315/335; 315/DIG. 7

[51] Int. Cl.[2] ..... H05B 41/22

[58] Field of Search ..... 315/261, 263, 268, 270, 315/271, 251, 252, DIG. 5, DIG. 7, 296, 330, 334, 339, 349, 151, 157, 158, 335, 224; 323/21, 28

[56] References Cited

UNITED STATES PATENTS

| | | | |
|---|---|---|---|
| 3,514,667 | 5/1970 | Dessoulavy et al. | 315/DIG. 5 |
| 3,700,960 | 10/1972 | Lake | 315/151 |
| 3,733,541 | 5/1973 | Elms | 315/349 |
| 3,789,266 | 1/1974 | Polman et al. | 315/DIG. 7 |
| 3,875,471 | 4/1975 | Buck | 315/151 |
| 3,881,147 | 4/1975 | Ueda et al. | 315/349 |
| 3,882,356 | 5/1975 | Stehlin | 315/DIG. 7 |
| 3,896,336 | 7/1975 | Schreiner et al. | 315/DIG. 7 |

*Primary Examiner*—Eugene R. La Roche
*Attorney, Agent, or Firm*—Arthur E. Bahr

[57] ABSTRACT

A circuit arrangement for starting a linear metal halide arc discharge lamp while in a transistor switching bridge inverter circuit in the running inverter mode. A high voltage pulse generator is connected to a trigger electrode which is arranged for capacitive coupling to the lamp to supply pulsed high voltage thereto. A synchronizing circuit serves to synchronize application of the high voltage pulse to the trigger electrode with the turn-on of either polarity of the switching inverter. An inhibit circuit prevents high voltage pulsing of the trigger electrode after lamp ionization when the lamp is in a normal operational mode.

16 Claims, 3 Drawing Figures

STARTING CIRCUIT FOR INVERTER OPERATED GASEOUS DISCHARGE LAMPS

BACKGROUND OF THE INVENTION

I. Field of the Invention

The present invention relates to a starting circuit arrangement for gaseous discharge lamps, and more particularly to a circuit arrangement for starting a linear metal halide arc discharge lamp while the lamp is in a semiconductor inverter circuit.

II. Description of the Prior Art

Gaseous discharge lamps of the long, linear, multicomponent, metal halide type are extremely susceptible to cataphoretic effects. That is, the color of the radiated light may vary along the length of the lamp due to the influence of thermal and electrical gradients and the like which act to produce a non-uniform dispersion of light emitting cations in the arc discharge lamp. Light feedback, closed-loop, electronic lamp current switching circuits have been devised to counteract these non-uniform dispersions. By controlling relative time of forward to reverse alternations of current in the lamp, it is possible to inject a DC current (superimposed on the AC current) which produces a cataphoretic bias of its own and can be poled so as to oppose the naturally occurring cataphoretic forces. It is possible to construct a circuit operating in such a negative light-feedback control system as described in U.S. Pat. No. 3,700,960 — Lake, assigned to the same assignee as the present invention, which will produce a uniform, axial, spectral energy density of light output for such lamps. One of the greatest difficulties facing designers has been in finding circuits which will reliably start such lamps without degrading or causing failure of the electronic switching apparatus needed to control cataphoresis as described.

In addition to being susceptible to cataphoresis effects, multicomponent metal halide lamps are difficult to start. The application of a very high ionizing voltage is required to initiate breakdown leading to a continuous arc discharge. It has been found, however, that, in pulse starting, crest voltages of 25 Kv with a typical rise time of one microsecond are required. This is not surprising since these are the typical parameters for pulse starting other long linear arc discharge lamps of similar dimensions. U.S. Pat. No. 3,700,960 — Lake discloses a metal halide lamp system; however, an arrangement as disclosed therein in FIG. 5, a Tesla coil was used as the source of high voltage for initiating breakdown of the linear metal halide lamp. A plurality of bypass switches shown in FIG. 5 thereof and totaling six in number are incorporated in circuit with the lamp 1 between DC input 11 and the circuit ground connection. These bypass switches are a set of mechanical contacts which serve to transfer aside and isolate the comparatively delicate semiconductor switching inverter switches from the deleterious effects of the high voltage starting pulses applied to the lamp during lamp starting.

Typically, the pulse starting voltage is 10 to 50 times greater than the blocking voltage rating of the highest voltage-rated power transistors suitable for each leg of a bridge inverter such as that disclosed in the aforementioned Lake patent. One can easily see that the destruction of these transistors would be the general consequence of attempts to start the lamp were it to be directly connected to the bridge inverter without special protective provisions.

It is desirable therefore to provide a starting circuit arrangement for a gaseous discharge lamp, for example a linear, multicomponent metal halide arc discharge lamp, while the lamp is in a semiconductor switching inverter circuit which is in the running inverter mode.

SUMMARY OF THE INVENTION

In accordance with the present invention, there is provided, in an electrical circuit having a semiconductor switching inverter responsive to alternating polarity drive signals for the alternating polarity operation of a gaseous discharge lamp from a DC energy source, a circuit arrangement for starting the lamp while in the inverter circuit. Included is a starting aid electrode mounted in close proximity to the lamp for capacitively coupling pulsed high voltage to the lamp. A high voltage source having an output connected to the starting aid electrode supplies a high voltage pulse to the lamp to effect starting thereof by ionization. Also included are means for synchronizing application of the high voltage pulse to the starting aid electrode with the turn-on of either polarity of the switching inverter while in the running inverter mode.

In the preferred embodiment, there is further included means for inhibiting high voltage pulsing of the starting aid electrode after lamp ionization when the lamp is in a normal operational mode.

DESCRIPTION OF THE PREFERRED EMBODIMENT

Figure 1:
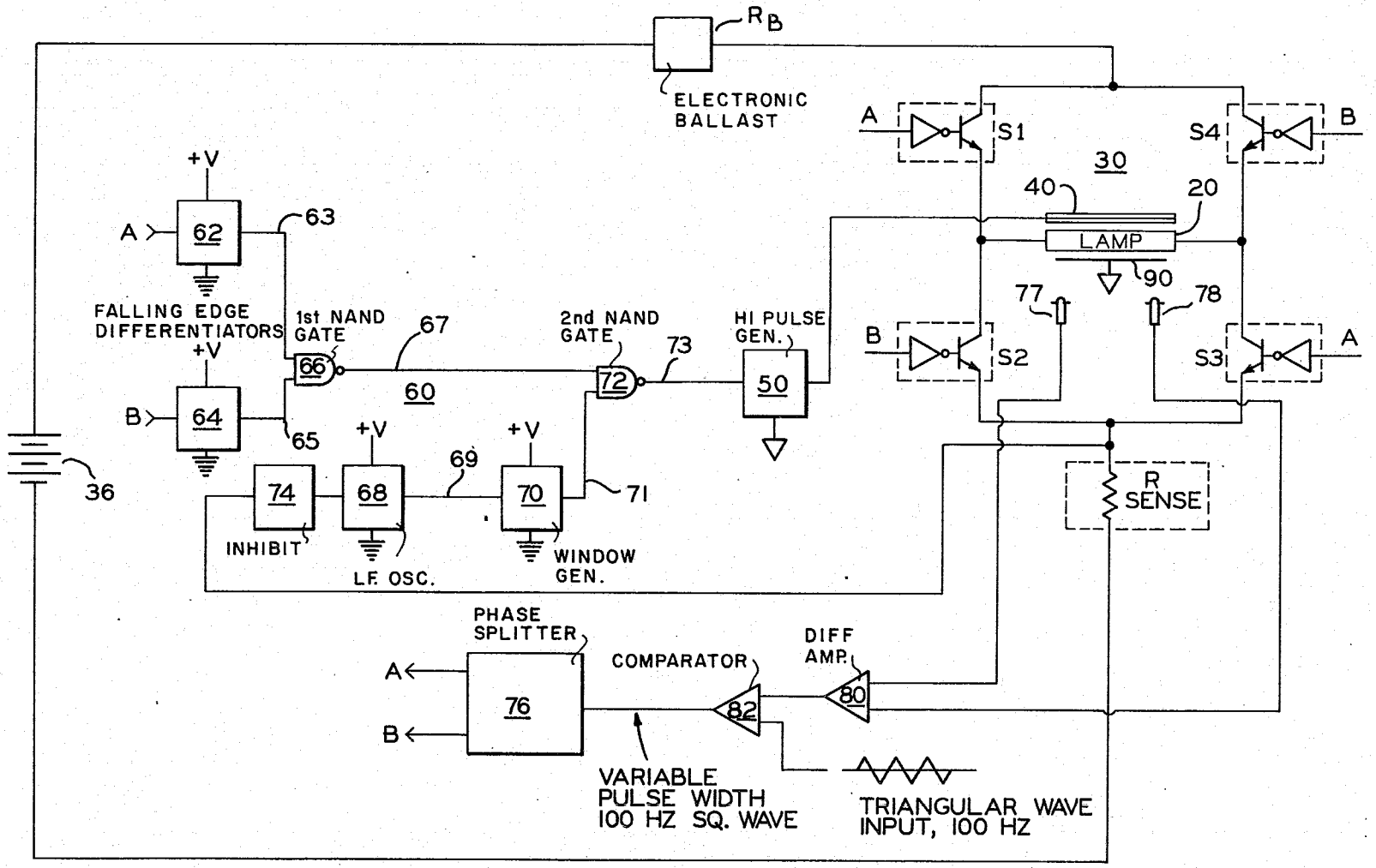
FIG. 1 is a functional block diagram of the preferred embodiment of the starting circuit arrangement for a gaseous discharge lamp in accordance with the present invention.

Referring to FIG. 1, there is shown, in functional block form, a circuit arrangement useful for starting a gaseous discharge lamp, as for example, linear, multicomponent metal halide lamp 20. A semiconductor switching inverter 30 of the transistor bridge type functions to operate the lamp 20 and is connected to a DC electrical energy source 36 of nominal 700 volts. Switching inverter 30 is of the high current switching type and may be of the type disclosed in U.S. Pat. No. 3,700,960 — Lake, assigned to the same assignee as the present invention. The specific switching inverter herein described is intended as exemplary and not limitative of the invention.

Switching inverter 30 includes transistor switches S1, S2, S3 and S4, the control of which may had from a light feedback control, time ratio, polarity modulated, electronic switching circuit as disclosed in the aforementioned Lake patent, the operation of which will be described hereinafter.

Figure 3:
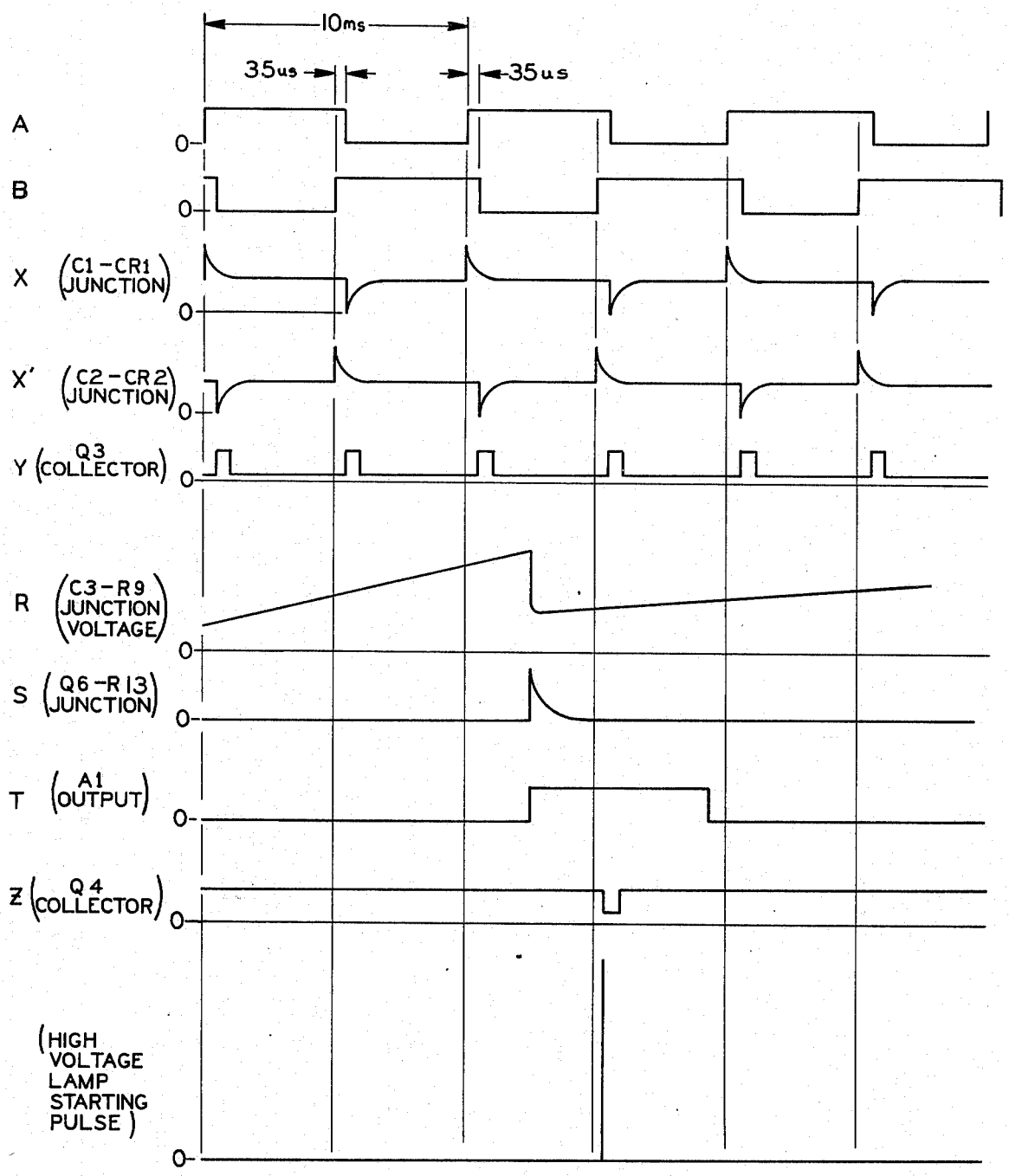
FIG. 3 records graphically the various waveforms appearing at the indicated circuit location.

The transistor switches are closed in pairs: S1 and S3 are on while S2 and S4 are off and vice versa. In the preferred embodiment, a pair of square wave drive signals of opposing polarity as shown at A and B in FIG. 3 are supplied to transistor switches S1, S3 and S2, S4, respectively, the driver signals chosen to be 100 Hz. By choice, a 35 microsecond deadtime period is provided; that is, a period of time when all four transistor switches are off to prevent possible shorting of the bridge.

In accordance with the present invention, there is provided a circuit arrangement for starting the lamp 20 while in inverter circuit 30 operating in the running inverter mode, that is, the switching operational mode. A starting aid electrode such as trigger electrode 40 is provided mounted in close proximity to lamp 20 for capacitively coupling pulsed high voltage to lamp 20. Also provided is a high voltage source such as high voltage starting pulse circuit 50 having an output connected to trigger electrode 40 for supplying high voltage pulses to the lamp 20 to effect starting thereof by ionization. Also included are means for synchronizing application of the high voltage pulse from pulse circuit 50 to the trigger electrode 40 with the turn-on of either polarity of the switching inverter 30 while in the running inverter mode, the means for synchronizing being generally denoted at 60. Forming a portion of the means for synchronizing application of the high voltage pulse with the turn-on of either polarity of the switching inverter is means for combining inverter polarity drive signals to produce a single positive level output pulse which, in the preferred embodiment, takes the form of a pair of falling edge differentiators 62 and 64 and a first NAND gate 66. Falling edge differentiators 62 and 64 serve to falling edge differentiate respectively both inverter polarity drive signals A and B to produce a pair of output pulses X and X′ (shown in FIG. 3) at points 63 and 65 respectively. First NAND gate 66 receives output pulses X and X′ and produces, in turn, a single positive level output pulse Y (FIG. 3) at 67. The means for synchronizing also includes means for generating a high level output pulse which takes the form of a basic low frequency oscillator 68 and a window generator 70. Oscillator 68 in the preferred embodiment is a free-running multivibrator operating at approximately 1 Hz to supply an output pulse S (FIG. 3) at 69 to window generator 70. Window generator 70 is, in the preferred embodiment, a monostable vibrator which, in response to output pulse S from oscillator 68, produces a high level output pulse T (FIG. 3) at 71 having a duration of approximately 7 milliseconds. Also included in the means for synchronizing is means for combining the single positive level output pulse Y and the high level output pulse T to trigger the high voltage starting pulse circuit 50, which in the preferred embodiment, takes the form of a second NAND gate 72. Second NAND gate 72 is responsive to the output pulses Y and T from the first NAND gate 66 and the window generator 70, respectively, to produce an output pulse Z (FIG. 3) at 73 to trigger the high voltage starting pulse circuit 50. A brief description of the operation of the circuit will now be had.

The starting function for lamp 20 is achieved in the following manner: high voltage DC, approximately 700 volts DC no load from source 36, is applied to the inverter 30 as shown and the switch pairs S1, S3 and S2, S4 are alternatively closed by "low" levels of the alternating polarity 100 Hz drive signals A and B. Thus, two phases of the 100 Hz square wave drive signal are available. These phases are falling edge differentiated at 62 and 64 respectively and the low level pulses X and X′ resulting therefrom are NANDED together at 66 to produce a positive level pulse Y on every falling edge of both phases of the 100 Hz square wave drive signal. Concurrently, it is desirable to have a high voltage pulse of about 25 Kv with 1 microsecond rise time applied to the lamp trigger electrode 40 at a repetition frequency of about 1 Hz. It is for this reason that the oscillator, free running multivibrator 68, operates at approximately 1 Hz. The 1 Hz pulse S is applied to window generator 70 which is then triggered to produce a high level pulse T of approximately 7 milliseconds duration, this being approximately 2 milliseconds longer than one-half period of the 100 Hz signal: i.e., 5 milliseconds. Thus, the output of the monostable-vibrator 70 goes high for a "window" of 7 milliseconds which will enable second NAND gate 72 such that when the positive pulse Y arrives from first NAND gate 66, second NAND gate 72 will turn on and energize high voltage starting pulse circuit 50 which will in turn apply the 25 Kv pulse to trigger electrode 40. It can be seen that the high voltage pulse from pulse circuit 50 will occur at the turn-on point of either pair of switches S1, S3 or S2, S4 in the inverter bridge 30. This important function is necessary for effective lamp starting and reliability of the solid state power switches. The high voltage pulse will never occur at the end of the inverter cycle or during the deadtime when all four transistor switches are off; thus reliable operation is achieved.

Means are also provided for inhibiting high voltage pulsing of the starting aid electrode 40 when the lamp 20 is in a normal operation mode (i.e., "on"), and takes the form of inhibit circuit 74, the operation of which will be discussed hereinafter.

Figure 2:
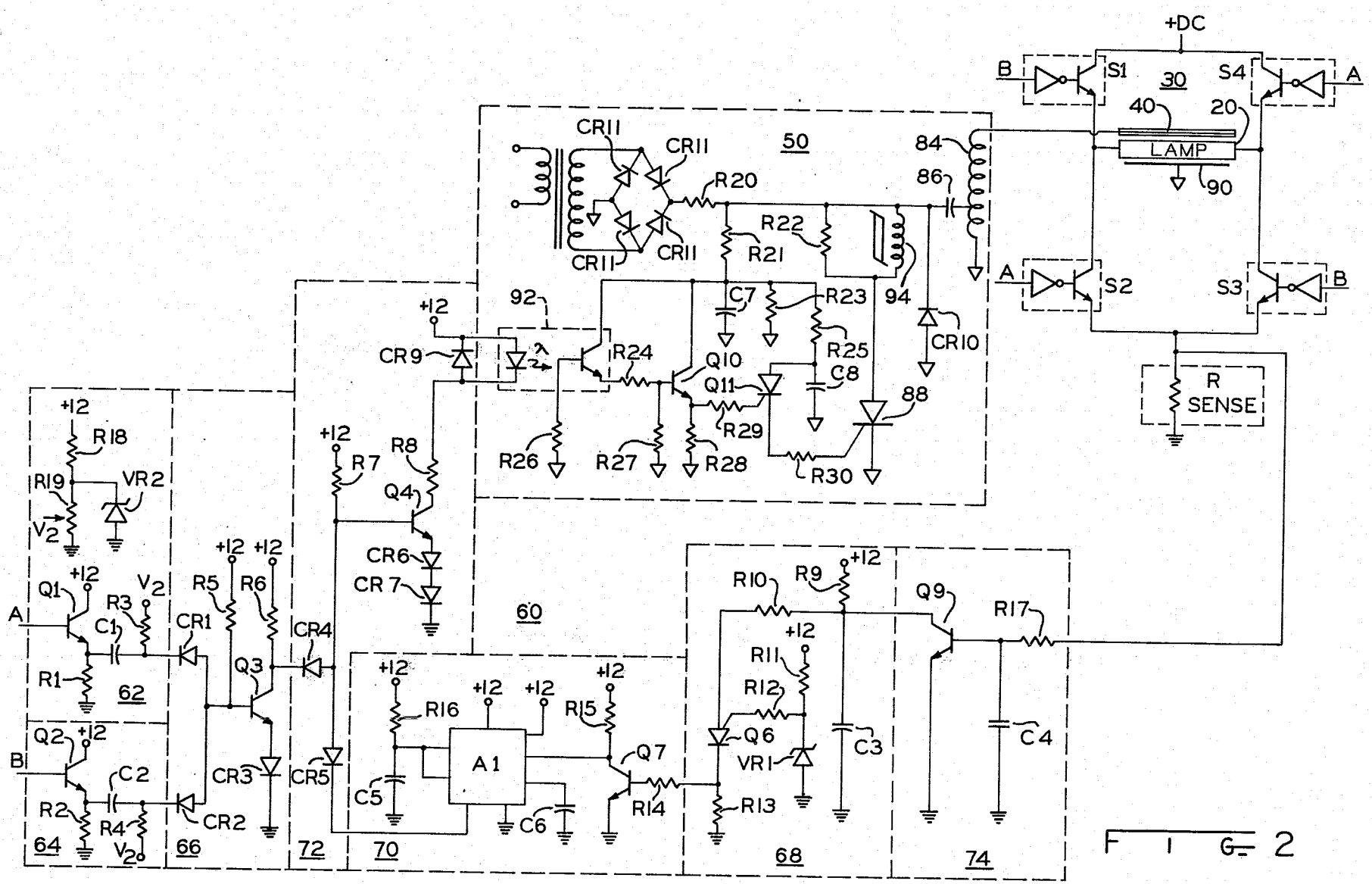
FIG. 2 is a detailed schematic representation of the preferred embodiment of the starting circuit arrangement of the present invention.

Referring now to FIG. 2 (in addition to FIG. 1), there is shown, by schematic diagram, a detailed circuit arrangement useful for starting metal halide lamp 20 while the lamp is physically located in solid state bridge switching inverter circuit 30 and while the bridge is in the switching operational mode. The switching inverter 30 functions to operate the lamp in an AC square wave mode from the high voltage DC source 36. The electronic ballast $R_B$ serves to ballast the zero or negative resistance running lamp load.

As stated hereinbefore, the switching inverter 30 includes four transistorized switches S1, S2, S3 and S4, the control of which is obtained from two phase signals, A and B, obtained from a 180° phase splitting circuit 76 forming a portion of an electronic switching circuit. The lamp 20 is connected across the two legs of the bridge. The two 180° out of phase signals A and B are obtained by splitting a single, variable pulse width, 100 Hz square wave, and providing a 35 microsecond delay during which both phases are in a state such as to cause all switches in the bridge to be OFF. The switches are energized in pairs, S1 – S3, and S2 – S4, and the 35 microsecond delay occurs after one pair turns OFF before the other pair turns ON. Active level low signals at A and B turn the transistor switches ON.

Linear wire trigger-electrode 40 is placed in proximity to the lamp 20 for capacitively coupling high voltage (about 25 Kv) pulsed energy into the lamp to ionize the gases and initiate lamp starting. After the gas is ionized by the high voltage pulse, the DC source 36 applied through the switching inverter 30 is sufficient to keep the lamp running.

To provide light feedback control, a pair of photosensors 77 and 78 are placed at opposite ends respectively of the lamp 20 to detect the level of light output at the respective ends. The outputs of the photosensors are compared by a differential amplifier 80 which produces a DC output proportional to the light difference at the ends of the lamp 20. The DC output is fed to one input of a simple comparator 82. The other comparator input is a plus and minus, 100 Hz triangular wave. If the DC output of the differential amplifier 80 is zero, the comparator 82 output is symmetrically high and low square wave: i.e., 50% duty cycle. Any positive or negative values of differential amplifier output will cause the comparator output to vary either more or less than 50%. The single output of the comparator 82 is fed to 180° phase splitting and time delay circuit 76 to produce two out-of-phase signals A and B. Since high level signals at A or B turn the respective inverter bridge switches OFF, there is provided a delay period of 35 microseconds when both A and B are high level signals. This delay assures that no two switches in the same leg of the bridge inverter 30 are ON at the same time, as such would result in shorting of the bridge inverter and certain destruction of the semiconductor elements. The above constitutes a light feedback control, time ratio, polarity modulated electronic switching circuit which is not a portion of the present invention.

Also provided in this circuit arrangement is a conventional high voltage starting pulse circuit 50 connected to the trigger electrode 40. Included in the pulse circuit 50 is a pulse transformer 84, charging capacitor 86, and a discharging thyristor switch 88. A ground plane 90 placed adjacent the lamp 20 is connected to the common side of pulse circuit 50. When a starting pulse is desired, a trigger signal is applied to the gate of the thyristor 88 and the charged capacitor 86 is discharged directly through a very small number of windings on the pulse transformer. Inductive coupling produces a high voltage energy pulse to be applied to the trigger electrode 40. Thus the pulse transformer 84 makes possible a transfer of energy stored in the capacitor 86 into the lamp 20 at a high potential so as to ionize the gases.

By the present invention, the bridge inverter circuit is in the normal switching mode and application of the high voltage starting pulse is synchronized to the turn-on of either polarity of the bridge inverter, i.e., the turn-on of either pair of diagonal switches in the bridge inverter 30.

Several points should be noted at this time. First, it is essential that the starting pulse not be applied during the 35 microseconds delay time when all four switches in the bridge inverter are in the OFF condition. This would mean that the ends of the lamp are not tied to a low impedance source and resultant voltages of 10 to 50 times the rating of the switches could occur. These voltages would destroy the semiconductor elements. Thus, information contained in both phases of the drive signals, A and B is necessary to be combined to produce the lamp starting pulse initiate signal. Secondly, it should be noted that, if the starting pulse could be synchronized to a unique point in the "on" period of either pair of switches, predictable and repeatable lamp starting performance could be achieved. Moreover, if this unique point is chosen to be the instant of turn-on of any pair of bridge inverter switches, the maximum amount of time will occur for the lamp arc to be initiated before the next 35 microsecond delay. Thus, again the chances of successful lamp starting are enhanced.

In accordance with the above discussion, there is provided a circuit which will synchronize the high voltage pulse to the turn-on of either pair of switches in the bridge inverter 30. Referring generally to FIGS. 1, 2 and 3 the inverter drive signals A and B are falling edge differentiated by the circuit elements 62 and 64 consisting of Q1, Q2, C1, C2, R1, R2, R3 and R4. CR1, CR2, R5, R6, Q3 and CR3 comprise the first NAND logic function; first NAND gate 66. If either input A or B is of a high level, the respective capacitor, C1 or C2, will be uncharged or charged to a very low level. When the input goes low, the voltage appearing at the junction of the respective capacitor and diode (for example, consider only the phase A input side) such as C1 and CR1 will go low for a brief length of time determined by the circuit components and the voltage V2 applies to R3 and R4. Q1 and Q2 provide low impedance sources to isolate the drive signals from this portion of the circuit. When the voltage at either of these capacitor-diode junctions goes low, the base drive current for Q3 is shunted away and Q3 turns off. When the junction voltage goes back high as the capacitor charges up to V2, the diode becomes reverse biased and Q3 turns back ON. An adjustment on V2 provides a means to vary the length of time that Q3 remains off. Thus, the collector of Q3 goes high at the falling edge of either phase of the inverter drive signals A and B. In the particular case of this embodiment, the positive pulse at Q3 collector is adjusted for 100 microseconds and since the basic bridge inverter frequency is 100 Hz, there is a string of positive 100 microsecond pulses spaced 5 milliseconds apart at the Q3 collector. FIG. 3 shows the waveform diagrams. The Q3 collector provides one input to the second NAND gate 72.

The other input to second NAND gate 72 is derived in the following way. It is desirous to apply the lamp starting pulses at about 1 Hz rate. A basic oscillator 68 consisting of the following elements is provided: R9, R10, R11, R12, R13, C3, VR1 and Q6. Q6 is a programmable unijunction transistor and the circuit is a simple free running oscillator. Capacitor C3 charges through resistor R9. When the charge on C3 exceeds the voltage established by VR1 and applied to Q6 through R12 by approximately 0.6 volts, Q6 turns ON and discharges C3 with a very fast time constant compared to the charging time constant. When C3 discharges sufficiently below the holding current of Q5, Q6 will turn OFF and C3 will begin to charge again. When Q6 turns ON, a voltage pulse occurs across R13. The voltage waveforms are shown also in FIG. 3.

The voltage pulse generated by the basic oscillator 68 once every second is used to trigger a window generator 70 consisting of an IC 555 timer monostable vibrator circuit. The window generator consists of elements R14, R15, R16, C5, C6, Q7 and A1. The output of the monostable circuit 70 is triggered high by the voltage pulse generated by the basic oscillator 68. The length of time that the monostable output is high is determined by the timing elements C5 and R16. In the preferred embodiment, this value is chosen to be approximately 7 milliseconds. Thus it provides a window in time of 7 milliseconds during which one or possibly two positive pulses will occur at the collector of Q3. The monostable output provides the second input to second NAND gate 72.

When both inputs are high simultaneously to second NAND gate 72, the base drive to Q4 is not shunted away by diodes CR4 or CR5 and Q4 turns ON. Current is drawn through the Light Emitting Diode (LED) of a photocoupler 92 which triggers the high voltage pulse generator 50; the Q4 collector, i.e., the output of second NAND gate 72, will be low for 100 microseconds. Since the first NAND gate 66 pulses occur 5 milliseconds apart, it is possible that more than one 100 microsecond pulse will occur during the 7 millisecond window; however, the recovery time of the high voltage pulse circuit 50 prohibits more than one high voltage pulse (HVP) from occurring.

In the waveform diagrams shown in FIG. 3, the HVP occurs at the turn-on Phase A. However, it is just as likely that the window would have occurred at the turn-on of Phase B. If the window generator frequency is an exact subharmonic of the main inverter frequency, then only one phase would initiate the HVP. If they are not exact harmonics, both phases will initiate the starting pulse.

A means is also provided in the preferred embodiment to sense the fact that the lamp is ON and to shut the pulse generator off and takes the form of inhibit circuit 74. Lamp current is sensed as positive voltage on the current sense resistor $R_{sense}$ which is filtered by R17 and C4 and used to turn on Q9 and prevent the charging of C3. This will inhibit the basic oscillator 68 and prevent the window generator 70 from being triggered, which will cause second NAND gate 72 to be constantly high thereby to prevent the pulse generator 50 from being triggered.

The starting circuit arrangement shown in FIGS. 1 and 2 has been constructed and has operated satisfactorily with components having the following values:

| | |
|---|---|
| Lamp 20 | 14 inch linear metal halide lamp |
| Transistor Switches: | |
| S1, S2, S3 and S4 | DTS 812 |
| Transistors: | |
| Q1 | 2N3392 |
| Q2 | 2N3392 |
| Q3, Q7, Q10 | 2N3392 |
| Q4 | 2N3392 |
| Q6 | 2N6027 |
| Q9 | 2N3859A |
| Q11 | C106B1 |
| Thyristor 88 | 64153 |
| Zener Diodes: | |
| VR1 | IN936 |
| VR2 | IN5232B (5.6V) |
| Integrated Circuit A1 | 555 Timer |
| Diodes: | |
| CR1, CR2, CR3 | IN4004 |
| CR4, CR5, CR6, CR7 | IN4004 |
| CR9 | IN458 |
| CR10 | IN5062 |
| CR11 | (4) IN5062 |
| Photocoupler 92 | MCT-2 (Q2398 - Monsanto) |
| Capacitors: | |
| C1, C2 | .0022μf |
| C3 | .22μf |
| C4 | .022μf |
| C5 | .022μf |
| C6 | .01μf |
| C7 | 50μf |
| C8 | .1μf |
| 86 | 1μf, 600V |
| Resistors: | |
| R1, R2, R14, R15, R20, R29 | 10K ohms |
| R3, R4 | 68K ohms |
| R5 | 120K ohms |
| R6 | 6.8K ohms |
| R7 | 15K ohms |
| R8 | 300 ohms |
| R9 | 2M ohms |
| R10 | 1K ohms |
| R11 | 270 ohms |
| R12 | 1M ohms |
| R13 | 680 ohms |
| R16 | 270K ohms |
| R17 | 27K ohms |
| R18 | 560 ohms |
| R19 | 2K ohms variable |
| R20, R23 | 10K ohms |
| R21 | 510K ohms |
| R22 | 100 ohms |

-continued

| | |
|---|---|
| R24 | 1K ohms |
| R25 | 150K ohms |
| R26 | 100K ohms |
| R27 | 4.7K ohms |
| R30 | 47 ohms |
| $R_B$ | Electronic Ballast |
| $R_{sense}$ | .25 ohms |
| Transformer 84 | 2 turns primary, 97 1/2 turns secondary |
| Saturable Inductor 94 | 25 turns, ferrit |

While an embodiment and application of this invention has been shown and described, it will be apparent to those skilled in the art that modifications are possible without departing from the inventive concepts herein described. The invention, therefore, is not to be restricted except as is necessary by the prior art and the spirit of the appended claims.

What is claimed is:

1. In an electrical circuit having a semiconductor switching inverter responsive to alternating polarity drive signals for the alternating polarity operation of a gaseous discharge lamp from a DC energy source, a circuit arrangement for starting the lamp while in the inverter circuit, comprising:

a starting aid electrode mounted in close proximity to the lamp for capacitively coupling pulse high voltage to the lamp;

a high voltage source having an output connected to the starting aid electrode for supplying a high voltage pulse to the lamp to effect starting thereof by ionization; and means for synchronizing application of the high voltage pulse to the starting aid electrode with the turn-on of either polarity of the switching inverter while in the running inverter mode.

2. The starting circuit arrangement of claim 1 further comprising:

means for inhibiting high voltage pulsing of the starting aid electrode after lamp ionization when the lamp is in a normal operational mode.

3. The starting circuit arrangement of claim 1 wherein the semiconductor switching inverter is adapted for direct coupling to the gaseous discharge lamp.

4. The starting circuit arrangement of claim 1 wherein the high voltage source includes a pulse generator of the capacitive discharge, pulse transformer type.

5. The starting circuit arrangement of claim 1 wherein the means for synchronizing includes:

means for combining inverter polarity drive signals to produce a single positive level output pulse;

means for generating a high level output pulse; and means for combining the single positive level output pulse and the high level output pulse to trigger the high voltage energy source thereby to supply a high voltage pulse for starting the lamp.

6. The starting circuit arrangement of claim 5 wherein the means for combining inverter polarity drive signals includes:

means for falling edge differentiating both inverter polarity drive signals to produce a pair of output pulses; and a first NAND gate receiving the pair of output pulses from the means for differentiating and producing a single positive level output pulse.

7. The starting circuit arrangement of claim 6 wherein the means for generating includes:

a basic low frequency oscillator; and a window generator responsive to an output pulse from the oscillator to be triggered to produce a high level output pulse.

8. The starting circuit arrangement of claim 7 wherein the means for combining pulses includes a second NAND gate responsive to the output pulses from the first NAND gate and the window generator, respectively, to produce an output pulse to trigger the high voltage source thereby to supply a high voltage pulse for starting the lamp.

9. In combination:

an electrical circuit having a semiconductor switching inverter for the alternating polarity operation of a gaseous discharge lamp from a DC energy source; and a circuit arrangement for starting the lamp while in the inverter circuit; the starting circuit including a starting aid electrode arranged such that the lamp may be placed in close proximity thereto for capacitively coupling high voltage to the lamp; the start circuit also including means having an output connected to the starting aid electrode for supplying a high voltage pulse thereto to effect starting of the lamp by ionization; the starting circuit further including means for synchronizing application of the high voltage pulse to the starting aid electrode with the turn-on of either polarity of the switching inverter while in the running inverter mode.

10. In an electrical circuit for operating a gaseous discharge lamp from a DC energy source, the circuit being of the type including a bridge switching inverter having two diagonal pairs of transistor switches arranged for connection across the DC source alternately serially between diagonal pairs thereof to effect alternating polarity operation of the lamp, a circuit arrangement for starting the lamp while in the bridge inverter circuit, comprising;

a starting aid electrode placed physically in close proximity to the lamp for capacitively coupling a high voltage pulse thereto to effect starting thereof by ionization;

a pulse generator connected to the starting aid electrode for supplying a high voltage pulse thereto;

means for synchronizing application of the high voltage pulse to the start aid electrode with the turn-on of either diagonal pair of transistor switches of the switching inverter when the switching inverter is in the running inverter mode; and means for inhibiting high voltage pulsing of the starting aid electrode after lamp ionization when the lamp is in a normal operational mode.

11. The invention as set forth in claim 10 wherein the means for synchronizing includes:

means for combining inverter polarity drive signals to produce a single positive level output pulse;

means for generating a high level output pulse; and means for combining the single positive level output pulse and the high level output pulse to trigger the high voltage energy source thereby to supply a high voltage pulse for starting the lamp.

12. The starting circuit arrangement of claim 11 wherein the means for combining inverter polarity drive signals includes:

means for falling edge differentiating both inverter polarity drive signals to produce a pair of output pulses; and a first NAND gate receiving the pair of output pulses from the means for differentiating and producing a single positive level output pulse.

13. The starting circuit arrangement of claim 12 wherein the means for generating includes:

a basic low frequency oscillator; and a window generator responsive to an output pulse from the oscillator to be triggered to produce a high level output pulse.

14. The starting circuit arrangement of claim 13 wherein the means for combining pulses includes a second NAND gate responsive to the output pulses from the first NAND gate and the window generator, respectively, to produce an output pulse to trigger the high voltage source thereby to supply a high voltage pulse for starting the lamp.

15. The starting circuit arrangement of claim 10 wherein the gaseous discharge lamp is adapted to be directly coupled to the bridge switching inverter.

16. The starting circuit arrangement of claim 10 wherein the pulse generator is of the capacitive discharge, pulse transformer type.

* * * * *

UNITED STATES PATENT AND TRADEMARK OFFICE

CERTIFICATE OF CORRECTION

PATENT NO. : 4,004,188

DATED : January 18, 1977

INVENTOR(S) : Robert C. Cooper

It is certified that error appears in the above-identified patent and that said Letters Patent are hereby corrected as shown below:

Column 4, line 15, --next-- should be inserted before "positive".

Column 6, line 44, "Q5" should read--Q6--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*